United States Patent [19]

Sato

[11] 4,340,643

[45] Jul. 20, 1982

[54] FLUID ANTIOXIDANT

[76] Inventor: Kozo Sato, 7-12, Minami 3-chome, Yamamoto-cho, Yao-shi, Osaka-fu, Japan

[21] Appl. No.: 189,940

[22] Filed: Sep. 22, 1980

[51] Int. Cl.[3] ..... B32B 5/16; B32B 17/00

[52] U.S. Cl. ..... 428/403; 252/397; 252/400 K; 427/212; 428/212; 428/325; 428/406; 428/446

[58] Field of Search ..... 428/212, 403, 325, 406, 428/405, 446; 427/219, 199, 217, 212; 252/400 R, 397

[56] References Cited

U.S. PATENT DOCUMENTS

| | | | |
|---|---|---|---|
| 3,286,604 | 11/1966 | de Vries | 428/406 |
| 3,420,645 | 1/1969 | Hair | 427/217 |
| 3,533,824 | 10/1970 | Terrill et al. | 427/217 |

*Primary Examiner*—Paul J. Thibodeau

*Attorney, Agent, or Firm*—Wenderoth, Lind & Ponack

[57] ABSTRACT

A fluid antioxidant for molten metal which comprises glass or ferrite in the form of tiny balloons having three or more sizes. The balloons are coated with powdered silicon and powdered spinel to make their surface softer and more abrasive.

3 Claims, 3 Drawing Figures

FLUID ANTIOXIDANT

BACKGROUND OF THE INVENTION

The present invention relates to a fluid antioxidant, and more particularly to a fluid antioxidant to be applied to the surface of a molten metal contained in a bath.

With a bath containing molten lead or tin, it is known that a large quantity of the molten metal is oxidized on its surface because of its contact with the air.

There have been two methods of preventing such oxidation. In one of them, organic substances such as oils and fats having a high flashing point are used to form a thick film at the interface between the molten metal and the air so as to isolate the former from the latter. In the other method, inorganic substances such as lime or graphite are used for the same purpose, usually in the form of pulverulent bodies and sometimes in the form of plates.

None of these organic or inorganic substances, however, have been free from drawbacks. Organic substances are not fit for repeated use because they are subject to fuming, carbonization, and/or change in properties when heated. Inorganic substances are apt to spray into the air and thereby pollute the surroundings and do harm to the workers. In addition, conventional inorganic antioxidants are apt to be coated with the molten metal and turn into a metallic mass.

SUMMARY OF THE INVENTION

It is an object of the present invention to provide an antioxidant which obviates the above-described drawbacks.

It is another object of the present invention to provide an antioxidant which suppresses the generation of noxious gases.

It is still another object of the present invention to provide an antioxidant which minimizes the loss of thermal energy of the molten metal.

With these objects in view, and as will become apparent from the following detailed description, the present invention will be more clearly understood in connection with the accompanying drawings.

DETAILED DESCRIPTION OF THE INVENTION

Figure 1:
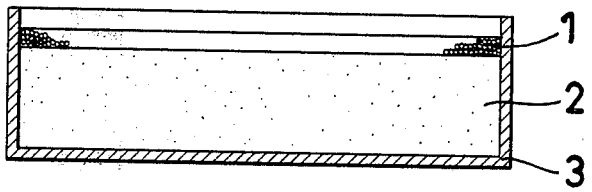
FIG. 1 is a vertical sectional view of a bath containing a molten metal, to the surface of which the antioxidant according to the present invention is applied.
Figure 2:
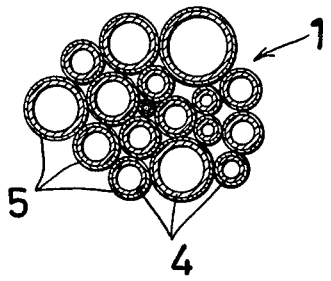
FIG. 2 is an enlarged sectional view of tiny balloons of which the antioxidant according to the present invention is made.

Referring now to FIGS. 1 and 2, an antioxidant in accordance with the present invention, which is generally designated by the numeral 1, is allowed to lie 3 to 5 cm deep on the surface of a molten metal 2 contained in a bath 3.

The antioxidant 1 is made of highly heat-resisting inorganic substances which take the form of tiny balloons 4. Three or more sizes of balloons having different diameters are mixed together so that the gaps left between larger balloons may be filled with smaller balloons. The balloons 4 are coated with a mixture 5 consisting of powdered silicon and powdered spinel ($MgAl_2O_4$) to make their surface softer and more abrasive.

To prepare the antioxidant in accordance with the present invention, three sizes of glass or ferrite balloons having different diameters of 0.5, 0.2 and 0.05 mm are mixed with powdered silicon, powdered spinel and a binder, and the mixture is moistened with a 1% solution of a nonionic surface active agent, and completely dried. The percentage by weight of each component is as follows:

| | |
|---|---|
| Glass or ferrite balloons | 35–45%<br>preferably 40% |
| Powdered silicon | 15–25%<br>preferably 20% |
| Powdered spinel | 30–40%<br>preferably 35% |
| Nonionic surface active agent | 1% |
| Binder | 4% |

The nonionic surface active agent is used to improve the miscibility and adsorbability.

The following example demonstrates a preferred embodiment of using the antioxidant prepared in accordance with the present invention.

EXAMPLE

Ferrite balloons coated with powdered silicon and spinel were allowed to lie 3 cm deep on the surface of molten lead contained in a bath which measured 1×1 m and is 0.4 m high. As controls, palm oil, lime powder, and ferrite balloons without the coating were used as antioxidants in the second, third and fourth baths. When not covered with any antioxidant, the temperature of the molten lead was 360° C. The accompanying table shows the results obtained from the four baths.

Figure 3:
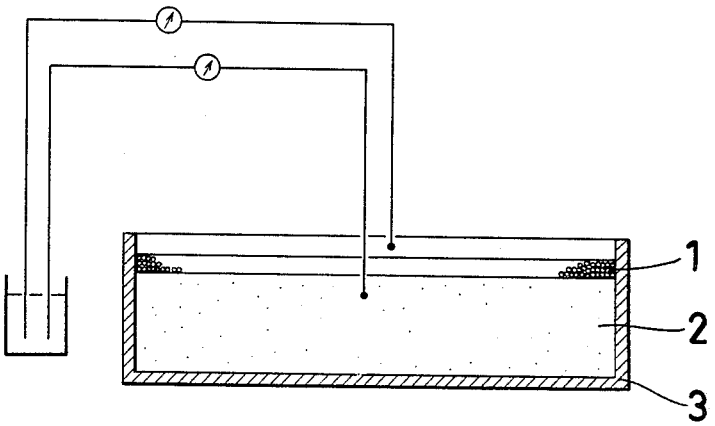
FIG. 3 is a vertical sectional view showing how the heat loss was measured.

FIG. 3 shows how the temperatures were measured above and below the interface between the antioxidant and the molten metal. A thermocouple type thermometer was used.

Figure 4:
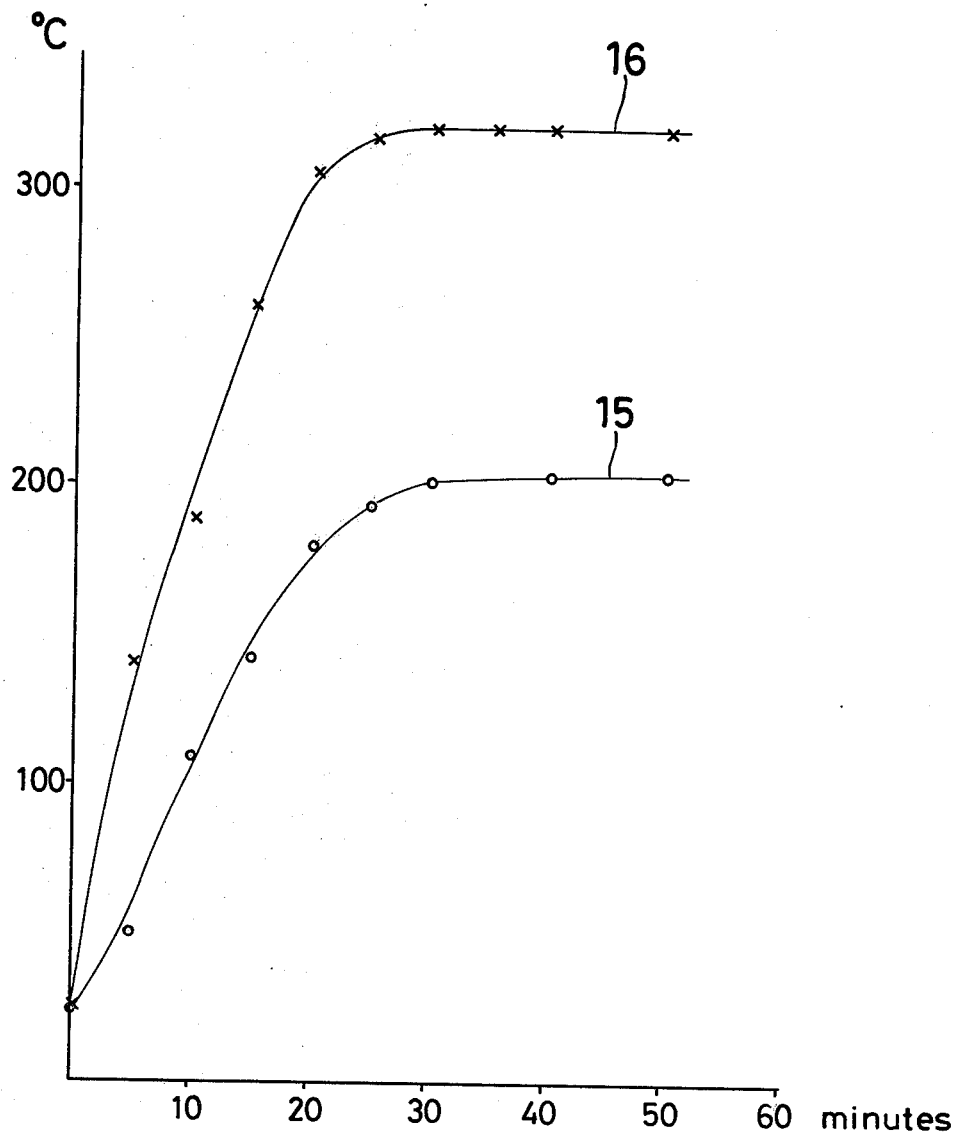
FIG. 4 is a temperature-time graph showing how much the heat loss of the molten metal is reduced by use of the antioxidant according to this invention.

Referring now to FIG. 4, temperature-time curve 15 shows the results obtained from a bath in which the molten metal was covered with the antioxidant of this invention, while curve 16 shows the results obtained from another bath in which the molten metal was not covered with any antioxidant. The ordinate denotes the temperature of the gas collected above the antioxidant or the uncovered molten metal while the abscissa denotes the length of time for which the molten metal is left to stand.

| Antioxidant | Palm oil | Lime powder | Ferrite balloons not coated | Ferrite balloons of this invention |
|---|---|---|---|---|
| Weight measured at start of experi- | 240 g | 850 g | 1,040 g | 1,020 g |

-continued

| Antioxidant | Palm oil | Lime powder | Ferrite balloons not coated | Ferrite balloons of this invention |
|---|---|---|---|---|
| ment | | | | |
| Weight measured at end of experiment | 105 g | 480 g | 985 g | 995 g |
| Remarks | Emitted smoke and foul odor and was oxidized. | Sprayed into the air. A large mass of lead was formed. | Some balloons were broken. | Satisfactory |
| Temperature measured 1 cm below interface between anti-oxidant and molten metal | 430° C. | 415° C. | 390° C. | 420° C. |
| Temperature measured 5 cm above inter-face | 140° C. | 120° C. | 135° C. | 95° C. |
| Lead content of gas collected 20 cm above inter-face | 0.01 ppm | 0.02 ppm | 0.05 ppm | 0.02 ppm |

The antioxidant in accordance with the present invention has an advantage that since the main components thereof are in the form of tiny balloons, it is prevented from spraying into the air.

The antioxidant in accordance with the present invention has another advantage that low thermal conductivity resulting from the hollowness of the balloons 4 minimizes the loss of thermal energy of the molten metal 2.

While I have disclosed a preferred embodiment of the present invention, it is to be understood that it has been described by way of example only and various modifications can be made.

What I claim is:

1. A fluid antioxidant for molten metal comprising a mixture of 35–45% by weight of balloons of at least three different diameters, said balloons being made of a member selected from the group consisting of glass and ferrite and being coated with a composition containing 15–25% by weight of powdered silicon, 30–40% by weight of powdered $MgAl_2O_4$, 1% by weight of non-ionic surface active agent and 4% by weight of binder, all percentages being based on the weight of the antioxidant.

2. A fluid antioxidant as claimed in claim 1, wherein the three different diameters are 0.5 mm, 0.2 mm and 0.05 mm.

3. A fluid antioxidant as claimed in claim 1 or 2, wherein the antioxidant comprises 40% by weight of the balloons, 20% by weight of the powdered silicon, and 35% by weight of the powdered $MgAl_2O_4$.

* * * * *